United States Patent [19]

Pester

[11] Patent Number: 4,821,435

[45] Date of Patent: Apr. 18, 1989

[54] SNOW PLOW ALIGNMENT AND STORAGE SYSTEM

[76] Inventor: William D. Pester, 2113 Cornelia St., Omaha, Nebr. 68147

[21] Appl. No.: 98,983

[22] Filed: Sep. 21, 1987

[51] Int. Cl.[4] ..... E01H 5/04

[52] U.S. Cl. ..... 37/231; 280/764.1

[58] Field of Search ..... 37/231, 235, 266, 279, 37/283; 280/764.1, 760, 769

[56] References Cited

U.S. PATENT DOCUMENTS

| | | | |
|---|---|---|---|
| 2,131,281 | 9/1938 | Harbes | 254/86 |
| 3,020,066 | 2/1962 | Torrey | 280/510 |
| 3,104,893 | 9/1963 | Torrey | 280/475 |
| 3,605,906 | 9/1971 | Coates | 172/272 |
| 3,715,132 | 2/1973 | Denny | 280/405.2 |
| 3,746,368 | 7/1973 | Gledhill | 280/481 |
| 3,828,449 | 8/1974 | Miceli | 37/283 |
| 3,934,852 | 1/1976 | Weber | 254/86 R |
| 3,982,768 | 9/1976 | Getman | 280/764.1 |
| 3,987,562 | 10/1976 | Deen | 37/261 |
| 4,304,056 | 12/1981 | Watson | 37/283 |
| 4,470,211 | 9/1984 | Rossman | 37/231 |

*Primary Examiner*—Eugene H. Eickholt

*Attorney, Agent, or Firm*—Zarley, McKee, Thomte, Voorhees & Sease

[57] ABSTRACT

A snow plow alignment and storage system for aligning a snow plow with respect to the plow mounting assembly of a truck having a wheeled carrier with a frame supported on caster wheels. A jack is removably mounted on a deck of the carrier for assisting vertical alignment of the snow plow frame. The deck is large from left to right and from forward to rearward to allow the jack to be rested thereon in various positions so as to adjust for variations in plow frames of different brands. Left and right notches in the frame to receive the lower edge of a snow plow blade.

16 Claims, 3 Drawing Sheets

SNOW PLOW ALIGNMENT AND STORAGE SYSTEM

BACKGROUND OF THE INVENTION

In the prior art it has been necessary to mount snow plows on trucks under very adverse conditions. Often there is sleet, snow, or rain, and blowing winds.

Some find it necessary, in an emergency, to mount snow blades on trucks while they still have good business clothes on. The problem is made greater by the great weight of a plow, necessitating the movement of a truck up to a plow. And greater yet because the truck must be aligned perfectly with the plow so as to pass attaching pins through confined openings in the plow supporting frame and in the truck mounting brackets which are attached to a truck for supporting the plow.

Much valuable time is consumed and much frustration is experienced as the truck is either too high or too low, too far to the left, or too far to the right, or out of alignment, both vertically and horizontally at the same time.

Another problem is the unevenness of the ground.

All these problems cause the operator to need to get out of the truck quite often to adjust the positioning of the blade mounting frame.

In addition to the need to go in and out of the truck, the blade itself is very heavy so that many who would like to mount a snow blade cannot physically accomplish the task.

An object hereof is to provide a snow plow alignment system which comprises a wheeled carrier for the snow plow, permitting the operator to align the plow up with respect to the truck, eliminating the need to align the truck up with respect to the snow plow.

Another object is to provide a system for vertical adjustment, using a jack supported by the snow plow carrier.

Another object is to provide for easy storage of the snow blade on its carrier when not in use, the carrier making possible a convenient positioning of the blade in an out-of-the-way place.

The ease of removal from a truck and the ease of replacement thereon of a plow using the system hereof makes it practical to drive a truck on most winter days without the plow attached for greater driving safely.

In the prior art trucks have been often driven with snow plows on them at times when there is no snow, because of the inconvenience of snowplow removal and re-mounting.

Plows stick out in front of a pick-up truck making driving in traffic hazardous as they average seven and a half feet in width dangerously wider than a truck.

As an average plow weighs about 600 lbs. and this weight is "way out" in front of the truck, the leverage factor this creates makes it all feel to the driver that the plow might break loose and accidentally fall.

In the prior art the sighting devices have been mounted on snow plow frames so that an operator of a truck can determine better the position of the snow plow. But because the alignment apertures are hidden by the hood of the truck, and because even one-half inch or one-fourth inch misalignment makes it necessary to maneuver the truck all over again, such devices have been of little help.

The present solution is to provide a carrier on which the plow can be maneuvered while the truck remains stationary, the carrier having an elevational system for elevating or lowering the rearward end of the plow frame to achieve alignment, the system employing a jack.

In the prior art many patents have been concerned with facilitating the attachment of a plow to a truck, but to my knowledge, none of them have utilized the principle of providing a wheeled carrier under a plow, making it possible to move the plow to the truck, in which case, a single operator's eye can sight the alignment.

Always before the single operator needed to be in the truck, maneuvering the truck so as to align with the attachments on the plow, in which case, the driver is blinded by the hood of the truck through which he cannot see. The attachments to be aligned are blocked from his view.

After the invention hereof was made, a search uncovered a U.S. Pat. No. 3,715,132, issued Feb. 6, 1973 to D. I. Denny, and titled: LOAD-SUPPORTING CARRIAGE STRUCTURE FOR TRAILERS. This patent shows a house trailer with ground wheels intended for highway operation, but as they are caster wheels, the speeds of highway operation would make it unusual in such a use because caster wheels are often dubbed "crazy wheels", vibrating and swinging excessively at high speed.

The torsion bar system of the patent leads to high cost, and low cost is an objection of the present invention.

It is desired that the present invention have its snow plow able to operate free of the wheel carriage which is only used during mounting, dismounting and storage.

DESCRIPTION OF THE PREFERRED EMBODIMENT

Figure 1:
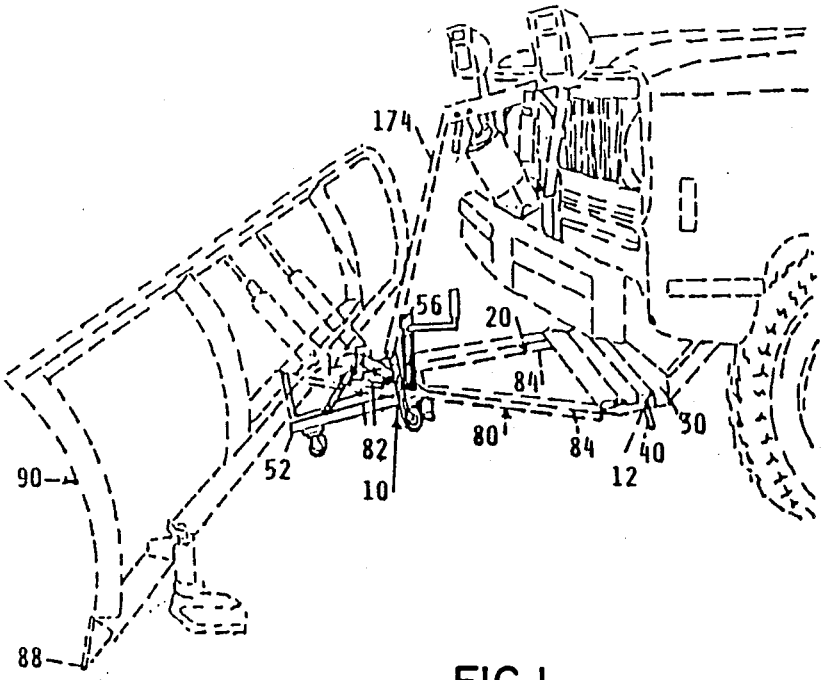
FIG. 1 is a perspective view of the snow plow alignmend and storage carrier of this invention shown in position under a snow plow with the forward part of a truck being shown. The parts are in the position they would be in immediately after the coupling of the snow plow to the truck.

The snow plow alignment and storage carrier of this invention is generally indicated at 10 in FIG. 1 and is for aligning mounting apertures 12 of a snow plow support module generally indicated at 20 of the prior art with cooperative apertures, not shown, of the truck mounting attachment module 30 of the prior art. This alignment is important so that pivot pins 40 can be inserted through the aligned apertures in a prior art manner.

A wheeled carrier 10 is provided for carrying the support module 20. The carrier 10 has a frame generally indicated at 52, and a jack 56 having a base portion 58 mounted on the frame 52. The jack 56 has an upper portion 64 elevatable with respect to the base 58.

Joists 66 are disposed one on the forward and one on the rearward side of the upper portion 64 of the jack 56. The jack 56 also has a portion 142 of smaller diameter telescoping inside the larger upper portion 74 of the jack, which latter moves up and down with respect to the lower portion 142 when a jack handle 150 is rotated. A joist foundation 70 is welded to the underside of the joists 66 and is removably received around the upper jack portion 64 by means of having an opening 71 in the foundation receiving the upper jack portion 64. The foundation 70 is welded at 73 to the joists 66. The foundation 70 is removably rested on a collar or footing 74 which is fixed to a lower end of the upwardly and downwardly movable jack portion 64, such fixing is by means of a welding at 76 in FIG. 5.

The joists 66 extend outwardly to right and left of the jack 56 and are for engaging the underside of the snow plow support module 20 which has main module frame members 80 disposed divergently with respect to each other, each being elongated and extending in a horizontal plane and being adjacent each other at their forward ends 82 and spread apart at their rearward ends 84.

Figure 3:
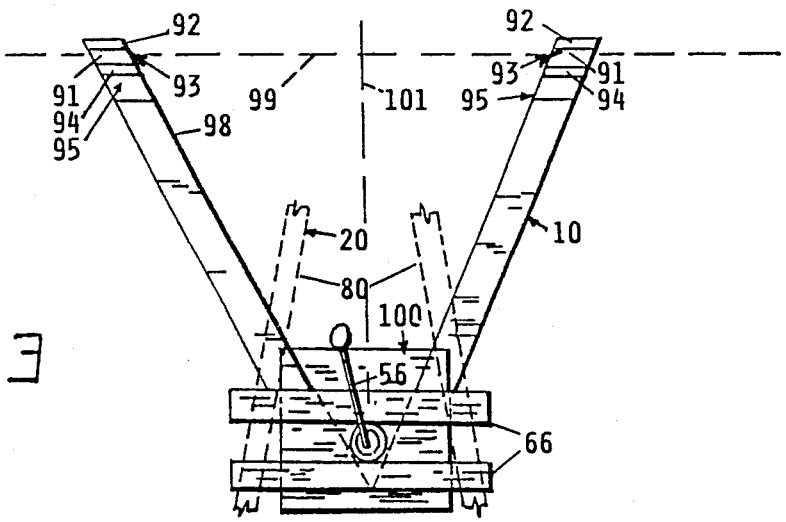
FIG. 3 is a top plan view of the alignment and storage carrier hereof.

The joists 66 engage the frame members 80 and hold them up while, at the same time, the lower edge 88 of the plow blade 90 is supported, as seen in FIGS. 3 and 6, in notches 91 formed in the upper side of the carrier frame 52.

The notches 91 are disposed above forward ends of later described side frame members 98 on the right and left sides respectively of the carrier frame 52.

Figure 2:
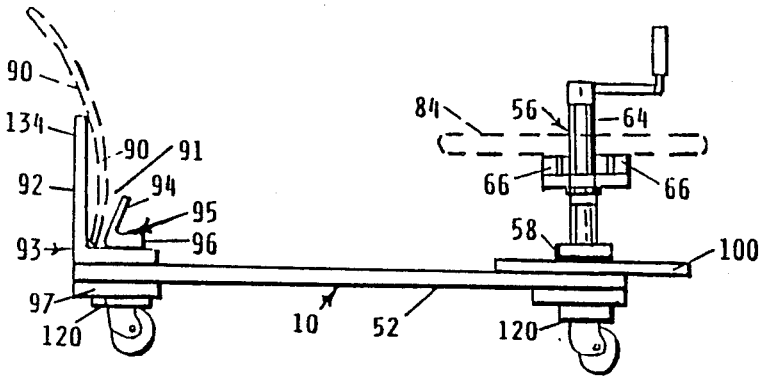
FIG. 2 is a side elevation of the carrier of this invention shown with some associating parts of truck and plow.

Referring to FIGS. 2 and 3, each notch 91 is disposed between an upwardly extending flange 92 of a base bracket 93 and an upwardly and rearwardly extending flange 94 of an upper bracket 95. The upper bracket 95 has a horizontal portion 96 suitably fixed to the horizontal portion 97 of the base bracket 93, the portion 97 being itself suitably fixed to the upper side of respective side frame member 98.

The notches 91 are above the forwardmost ends of the side frame members 98 and are each elongated from left to right along a line 99 of FIG. 3 which can represent the rested position of the lower edge 88 of the plow blade 90.

Ends of the side frame members 98 are spaced equidistances to the right and left of the line 101 extending forwardly and rearwardly through a center of the rearward end of the frame 52 and through a center of the area of a deck 100 in top plan view.

The forward ends of the side frame members are spaced apart whereby the lower edge of the blade 90 is not supported between the notches 91. This has the advantage that moisture and snow cannot collect on and rust the lower edge 88 of a blade in the area between the side frame members 98.

Figure 4:
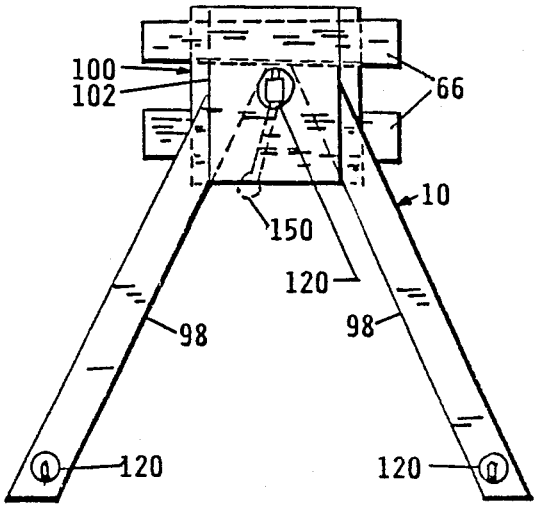
FIG. 4 is a bottom plan view of the alignment and storage carrier hereof.

And so the carrier 50 can be seen in FIGS. 3 and 4 to be much wider at its forward end 112 than at its rearward end 118.

The two side frame members 98 are attached together at their rearward ends by an under-plate 102 and by an upper plate called a deck 100.

Figure 5:
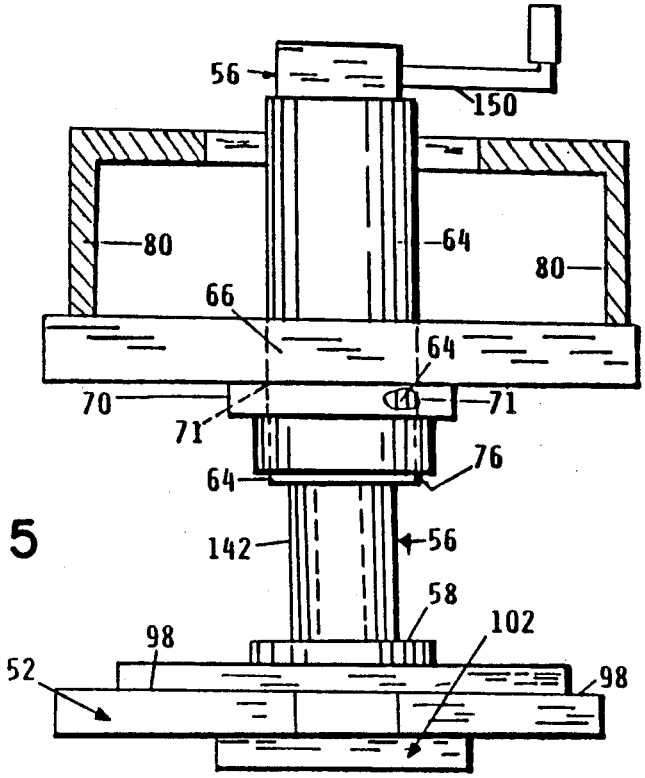
FIG. 5 is a rear elevation of the joists hereof which engage the underside of a plow supporting A-frame and of a joist foundation fixed to an upwardly movable part of a jack.

The deck 100 is fixed to the upper side of the rearward ends of the side frame members 98 and is of a width from left to right, as seen in FIG. 5, which is approximately three times the left to right dimension of the base 58 of the jack. This permits a shifting of the jack from left to right to quickly adjust positioning as it is important only that the joists be received under the snow plow module frame members 80, and it is not important where the base of the jack engages the deck 100, except that it be supported thereby.

The deck 100 also has a substantial dimension from its forward end to its rearward end, and preferably at least about twelve inches so as to freely adjust the position of the joists 66 with respect to the side frame members 80 of the plow support module. This is because the side frame members 80 vary in position with respect to the lower edge 88 of the blade in each of many brands of snow plows.

Expressed in another way, the forward to rearward dimension of the deck 100 should be at least twice the forward to rearward dimension of the lower portion 142 of the jack 56 in order to accomodate a plurality of brands of blade support modules, although at least twice will take care of two brands, at least three times will take care of three.

It is not as important what the dimension of the deck 100 is from forward to rearward with respect to the jack base 58 as it is with respect to the diameter of the lower jack portion 142.

The jack bases can vary in dimension and no jack base at all is really needed because a turning of the crank 150 to put the jack under the plow support module pressure will itself hold the jack in place.

Three caster wheel assemblies 120, one at each corner of the frame 52, extend downardly therefrom and are attached thereto. Caster wheels make maneuverability excellent because they are free to pivot in any direction.

Three caster wheel assemblies 120 are used, one at each corner of the frame 52, and are attached to and extend downwardly therefrom. The caster wheels are free to pivot in any direction.

In FIG. 2 a bracket 92 carrying the lower edge 88 of the plow blade 90 is fixed to the upper side of and extends along the forward frame member 96 providing an upstanding flange 134, the rearward side of which engages the forward side of the plow blade 90, retaining the plow blade 90 from moving off of the forward side of the carrier 50. The jack 56 has its base removably supported on the upper plate 100 of the carrier 50.

The jack 56 has a portion of smaller diameter 142 extending upwardly from the base 58 and has a cylinder of larger diameter 64 telescopingly received on the lower portion 142 and capable of movement up and down as the jack handle 150 is rotated.

During attachment, the plow is maneuvered to the truck on its wheel-carrier 50 and the jack 56 is operated to bring the apertures 12 of the support module 20 into alignment with cooperative apertures, not shown, of a truck mounting attachment module 30 which is fixed to a truck shown partially in dotted lines at 170. When alignment is accomplished, the pivot pins 40 are inserted from the right and left sides of the truck. After that, the plow support module 20 can be raised by means of a chain 174 and a hydraulic lifting system 176 attached to the truck. Then the carrier can be removed.

A reversal of these same steps is done to place the plow back on the carrier. After that, the plow can be conveniently stored in a tight and crowded place because of maneuverability made possible by the three caster wheel assemblies 120.

I claim:

1. A snow plow alignment and storage carrier for aligning the mounting apertures of a snow plow support module with cooperative apertures of a truck-mounted attachment module, said carrier comprising: a frame having wheels thereunder, a plow blade lower edge engaging means at the forward end of said frame and capable of engaging and supporting the lower edge of a plow blade when such blade is in a carrying position on said carrier, an elevating means supported by a rearward end of said carrier frame, said elevating means having a portion elevatable with respect to said carrier frame, snow plow support module engaging means attached to said elevatable portion and capable of engaging and supporting the underside of said snow plow support module while a snowplow blade is in said carrying position whereby as said elevatable portion is raised with respect to said carrier frame said support module will be raised so that said carrier with said snowplow thereon can be moved across a supporting surface thereunder so as to assist alignment of said apertures of said plow support module with said apertures of said attachment module whereby pivot pin means can be inserted through said apertures to pivotally mount said plow support module on said truck-mounted attachment module.

2. The snow plow alignment and storage carrier of claim 1 wherein said carrier frame has at least one caster wheel under it.

3. The snow plow alignment and storage carrier of claim 1 wherein said carrier frame has wheels each of which is a caster wheel for ease of movement in any direction of a snow plow blade and its support module for facilitating storage and truck-connection.

4. The snow plow alignment and storage carrier of claim 1 wherein the forward end of said frame has a notch means in its upper side for receiving the lower edge of a plow blade therein.

5. The snow plow alignment and storage carrier of claim 1 wherein at least one upwardly projecting blade retainer flange is attached to a forward portion of said carrier frame to retain said plow on said carrier.

6. The snow plow alignment and storage carrier of claim 1 wherein said jack has a handle at its upper end which is rotatable in a horizontal plane so as to be moving in an area above and not conflicting with said plow support module.

7. The snow plow alignment and storage carrier of claim 1 wherein said elevating means is a jack.

8. The snow plow alignment and storage carrier of claim 1 in further combination with said snowplow and plow support module and wherein said elevating means is a jack having a rotatable control handle, said handle being rotatable in a horizontal plane and disposed above and not conflicting with said plow support module when said plow and plow support module are on said carrier in said carrying position.

9. The snow plow alignment and storage carrier of claim 8 wherein, said carrier having a straight reference line extending from right to left substantially at the forward side of said carrier frame, said carrier having a center line extending forwardly and rearwardly of said carrier frame and through the center there of, said carrier having a jack-supporting deck at its rearward end on which said jack is movably rested, said deck having a forward edge which is within substantially 17 inches of the forward side of said frame as measured along said centerline of said carrier.

10. The snow plow alignment and storage carrier of claim 8 wherein said carrier has a straight reference line extending from right to left substantially at the forward side of said carrier frame, said carrier having a center line extending forwardly and rearwardly of said carrier frame and through the center thereof, said carrier having a jack-supporting deck at its rearward end on which said jack is movably rested, said deck having a rearward edge which is at least substantially 29 inches from the forward side of said frame as measured along said centerline of said carrier.

11. The snow plow alignment and storage carrier of claim 10 wherein said jack has a lower telescoping portion, said deck having a left-to-right dimension which is at least substantially double the left-to-right dimension of said lower telescoping portion.

12. The snow plow alignment and storage carrier of claim 8 wherein said jack has a lower telescoping portion, said deck having a left-to-right dimension which is at least substantially double the left-to-right dimension of said lower telescoping portion.

13. The snow plow alignment and storage carrier of claim 1 wherein at least one upwardly projecting blade retainer flange is attached to a forward portion of said carrier frame to retain said plow on said carrier, spaced upwardly projecting guide flange means disposed spaced behind said retainer flange so as to provide a notch therebetween, the forward side of said guide flange means having an inclination at an acute angle with respect to the vertical so as to incline downwardly and forwardly as its lower end is approached from its upper end so that when a downwardly moving blade edge strikes said guide flange the blade edge will be deflected and guided forwardly and downwardly.

14. The snow plow alignment and storage carrier of claim 1 wherein said elevating means is supported on a supporting surface of said frame, said elevating means being removable from said carrier frame, said carrier having a height dimension at its rearward end as measured from said supporting surface to the underside of said wheeled frame, said height dimension being less than 7 inches so as to cause said plow mounting apertures to be low enough for said alignment.

15. The snow plow alignment and storage carrier of claim 14 wherein said height dimension is less than 6 inches.

16. The snow plow alignment and storage carrier of claim 1 wherein said height dimension is less than 5 inches.

* * * * *